United States Patent [19]

Honkomp et al.

[11] Patent Number: 5,017,740

[45] Date of Patent: May 21, 1991

[54] FUSED HERMETIC TERMINAL ASSEMBLY INCLUDING A PIN GUARD AND LEAD WIRE END CONNECTION SECURING DEVICE ASSOCIATED THEREWITH

[75] Inventors: Glenn A. Honkomp, Warren; Eugene H. Tingley; Thomas O. McNay, both of Clermont, all of Ohio; Benjamin Bowsky, St. Louis, Mo.

[73] Assignee: Emerson Electric Co., St. Louis, Mo.

[21] Appl. No.: 503,480

[22] Filed: Apr. 2, 1990

[51] Int. Cl.[5] ..... H01B 17/30; H01R 13/74

[52] U.S. Cl. ..... 174/152 GM; 174/138 F; 337/1; 337/273; 439/892

[58] Field of Search ..... 174/74 A, 138 F, 152 GM; 337/1, 181, 273, 276, 279, 405; 417/422, 902; 439/181, 183, 186, 187, 135, 149, 150, 367, 519, 521, 566, 621, 622, 685, 693, 892, 893, 926, 935

[56] References Cited

U.S. PATENT DOCUMENTS

| | | | |
|---|---|---|---|
| 3,160,460 | 12/1964 | Wyzenbeek | 439/685 |
| 3,179,773 | 4/1965 | Keeley, Sr. | 339/276 |
| 3,601,737 | 8/1971 | Baird et al. | 337/273 X |
| 4,252,394 | 2/1981 | Miller | 174/152 GM X |
| 4,296,275 | 10/1981 | Bowsky | 174/152 GM |
| 4,461,925 | 7/1984 | Bowsky et al. | 174/152 GM |
| 4,580,003 | 4/1986 | Bowsky et al. | 174/152 GM |
| 4,584,433 | 4/1986 | Bowsky et al. | 174/152 GM |
| 4,609,774 | 9/1986 | LeMieux et al. | 174/152 GM |
| 4,676,569 | 6/1987 | Lambert et al. | 439/892 X |
| 4,739,551 | 4/1988 | Bowsky et al. | 174/152 GM X |
| 4,786,762 | 11/1988 | Bowsky et al. | 174/152 GM |

FOREIGN PATENT DOCUMENTS

| | | | |
|---|---|---|---|
| 3326049 | 1/1985 | Fed. Rep. of Germany | 439/893 |

*Primary Examiner*—Laramie E. Askin

*Attorney, Agent, or Firm*—Polster, Polster and Lucchesi

[57] ABSTRACT

A hermetic terminal assembly for a housing including a fuse-like area positioned in the outer pin segment of a terminal pin extending in sealed relation through the body member of the terminal assembly which body member can be sealed to a housing wall, the fuse-like area in the outer pin segment being covered with a thermally decomposable coating which in the event of decomposition includes an arc suppressant. A pin guard and lead wire end connection securing device is provided to protect the outer pin segment and to secure the lead wire end connection thereto.

22 Claims, 2 Drawing Sheets

FUSED HERMETIC TERMINAL ASSEMBLY INCLUDING A PIN GUARD AND LEAD WIRE END CONNECTION SECURING DEVICE ASSOCIATED THEREWITH

BACKGROUND OF THE INVENTION

The present invention relates to hermetic terminal assemblies and more particularly to a fused hermetic terminal assembly including an improved fuse, and also to an improved pin guard and lead wire end connection securing device associated with the hermetic terminal assembly.

It is known in the art of hermetic terminal assemblies to employ a current carrying electrically connected terminal pin, which pin incorporates a reduced fuse-like area generally located on the inner segment of the pin on the inner dish side face of a cup-shaped body of the terminal assembly. The cup-shaped body, in turn, is mounted in sealed relation on a housing wall with the inner segment of the pin being confined therein. It also is known in the art to include a stop flange between the extremity of the inner segment of the pin and such fuse-like area within the cup-shaped body in the event such fuse-like area should melt because of abnormally excessive current conditions. In this regard, attention is directed to U.S. Pat. No. 4,584,433 issued to Benjamin Bowsky et al. on Apr. 22, 1986; U.S. Pat. No. 4,609,774 issued to David M. LeMieux et al. on Sept. 2, 1986; and, to U.S. Pat. No. 4,739,551, issued to Benjamin Bowsky et al. on Apr. 26, 1988, each of which patents broadly teaches the utilization of a fuse-like area incorporated as part of an inner segment, of a pin and a flange member associated therewith, the latter patent further teaching the roll-forming of such fuse-like area. In addition, attention is directed to U.S. Pat. No. 4,461,925, issued to Benjamin Bowsky et al. on July 24, 1984, which patent teaches a terminal pin having a stop flange associated therewith and which further includes a reduced area positioned immediately adjacent the outside area of the seal and cup-shaped body with no mention being made in this patent of a coating for such reduced area or of a pin guard and lead wire end connection securing device. Attention also is directed to U.S. Pat. No. 4,252,394, issued to Austin S. Miller on Feb. 24, 1981, which teaches a terminal pin having two sections of different cross-sectional area with the larger and smaller sections joining within the sealing area inside the cup-shaped body. Finally, attention is directed to U.S. Pat No. 3,160,460, issued to A. Wyzenbeek on Dec. 8, 1964 and U.S. Pat. No. 4,296,275, issued to B. Bowsky on Oct. 20, 1981, each of which broadly teaches the use of a silicone rubber insulator on the outer face of the cup-shaped body of a terminal assembly to insulate the body, with the insulator including spaced protuberances to insulate a portion of the terminal pins extending from the outer face of the cup-shaped body, U.S. Pat. No. 3,160,460 also broadly suggesting an outer pin segment guard in the form of a terminal block.

In accordance with the present invention, it is recognized that, as suggested in the earlier Bowsky et al. U.S. Pat. No. 4,461,925, it is desirable to locate the fuse-like area adjacent the outer face of the cup-shaped body of a terminal assembly to keep abnormally excessive currents from reaching and melting the glass which serves to form a seal between the pin and cup-shaped body of the terminal assembly. It further is recognized by the present invention that, if the glass seal between pin and cup-shaped body reaches an elevated temperature above that anticipated for the fuse-like area to reach softened or molten state, it offers a path for a trickle current and eventually this could allow the terminal assembly to vent to ambient. Such a desirable relative location of the fuse-like area of the pin of the terminal assembly outside the cup-shaped body not only has not been utilized in the more recent past, but, as is reflected in the structure disclosed in the aforementioned later issued patents to Bowsky et al., namely U.S. Pat. Nos. 4,584,433 and 4,739,551, the fuse-like area incorporated in the pin has been located on the inner segment of the terminal assembly pin, usually between a comparatively costly to manufacture stop-flange and the extremity of the inner segment of the pin, notwithstanding such glass melting problems. The present invention, recognizing the desirability of the location for the fuse-like area on the outer face or outside of the terminal assembly and further recognizing the reason for avoiding such selection in the recent past, provides a novel structure which obviates these now recognized problems, the present invention including the utilization of a novel, comparatively light and inexpensive means for covering the exposed outer segment of a pin in which the outer fuse-like area has melted, such means functioning like a terminal block and further serving as a pin restraint during normal operations to avoid usage of the comparatively costly and more difficult to assemble stop-flange on the inner segment of the terminal pin and the cumbersome and comparatively difficult to assemble outer pin segment guard assemblies mounted on outer housing walls in past arrangements. In addition, the present invention provides a novel current resistive pin guard and lead wire end connection securing device for the outer segment of the pin means and wire connections of a terminal assembly which, in the event of fuse melt, serves to hold the lead wire ends in position to help prevent free floating of electrically alive wires. Further, the present invention not only provides a novel, comparatively inexpensive to manufacture and assemble current resistive integral pin guard and lead wire end connection securing device for the external segments of otherwise exposed outer pin segments of a terminal assembly, but also provides a novel means for readily mounting such integral pin guard and lead wire end connection securing device allowing the same to be bonded or fastened firmly in place to restrict ready access thereto, thus helping to minimize some of the safety problems which can arise through improper repair attempts.

Various other features of the present invention will become obvious to one skilled in the art upon reading the disclosure set forth herein.

SUMMARY OF THE INVENTION

More particularly, the present invention provides a hermetic terminal assembly for a housing comprising: a cup-shaped body with a bottom having an inner and outer face and a rim extending from the inner face of the bottom, the bottom having at least one hole with a defined perimeter; a current conducting pin extending through the hole, the pin including an outer pin segment to extend externally of the cup-shaped body to receive a lead wire end connection outside of the cup-shaped body and an inner pin segment to receive a lead wire end connection disposed in the housing to which the cup-shaped body is sealed; a glass seal bonding the pin to the defined perimeter of the hole in the cup-shaped body; the outer segment of the pin including a fuse-like area adjacent the outer face of the bottom of the cup-shaped body; and an insulating, thermally decomposable coating covering the outer segment fuse-like area, the coating including a high temperature arc suppressant and having a thermal decomposition temperature point lower than the melting point of the fuse-like area so that the coating will decompose to cover the outer end of the inner pin segment and thereby abate electrical flow to the inner segment of the pin in the event of the fuse-like area melting due to abnormally excessive current conditions.

In addition, the reduced fuse-like area serves to reduce transmissions of shock to the glass seal area. Further, the present invention makes use of a rolled pin to include an inner core and outer jacket of a preselected diameter ratio and provides a sleeve configuration for the inner pin segment that optimizes current oversurface conditions opposite the embedded sleeve end and yet maintains optimum insulating conditions adjacent the embedded sleeve end relative to the cup-shaped body. It, of course, is to be understood that any one of a number of pin-forming materials can be used and that the sleeve configuration could be varied as the situation might require. Even further, the present invention provides an electrically insulating sleeve surrounding the inner segment of the pin with one end of the sleeve embedded in the glass seal to minimize the possibility of electrical arcing between the pin and the cup-shaped body. Finally, the present invention provides a novel, current resistive, protective pin guard and lead wire end connection securing device having opposed top and bottom ends with the top end closed and the bottom end adapted to receive and be fastened to surround the terminal assembly and the lead-wire end of an electrical connection outside the housing which passes into the pin guard and lead wire end connection securing device to fasten to the outer pin segment, the pin guard and lead wire end connection securing device acting as a diffuser in the event of terminal assembly leakage. Such novel device not only can be readily manufactured and assembled but, in addition, it can serve to eliminate the cumbersome and difficult to manufacture and assemble box-like guard arrangements which have been mounted to the housing in the past.

It is to be understood that various changes can be made by one skilled in the art in one or more of the several parts of the structure disclosed herein without departing from the scope or spirit of the present invention. For example, it would be possible to vary the configuration of the cup-shaped body member, the number and type of pins used and the pin sealing material and the configurations of the protective sleeves for such pin, both within the cup-shaped body and outside thereof.

BRIEF DESCRIPTION OF THE DRAWINGS

Referring to the drawings which disclose an advantageous embodiment of the present invention including a modified wire securing and protective pin guard and lead wire end connection securing device.

DETAILED DESCRIPTION OF THE DRAWING

Figure 1:
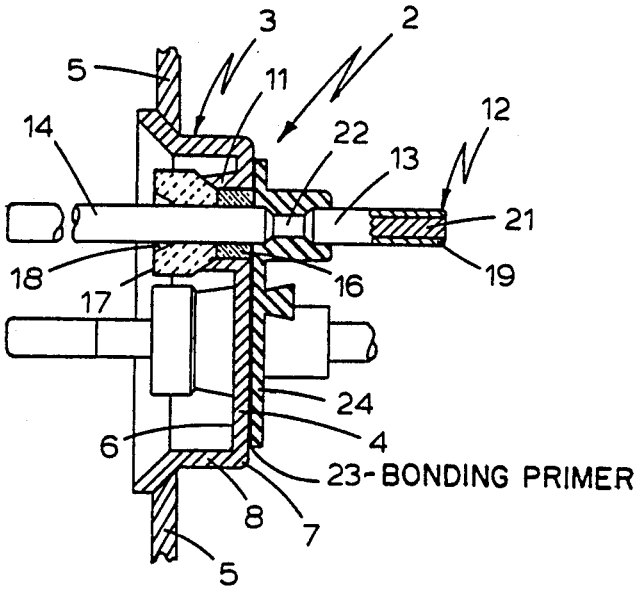
FIG. 1 is a cross-sectional broken view of the inventive hermetic terminal assembly taken in a plane through line 1—1 of FIG. 2, a portion of the outer segment of the terminal pin being broken away to disclose the jacketed inner core thereof.
Figure 2:
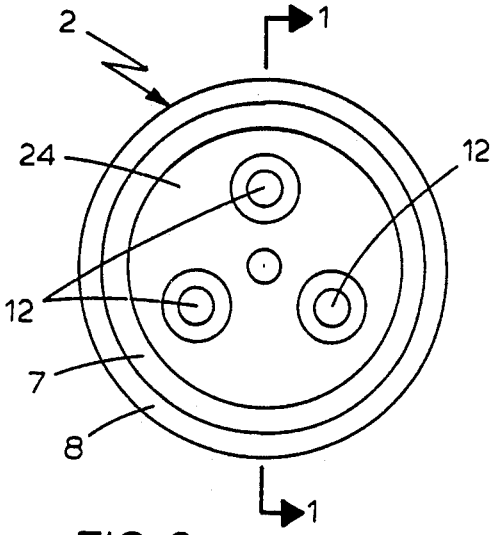
FIG. 2 is a top plan view of the terminal assembly of FIG. 1.

Referring to FIGS. 1 and 2 of the drawings, the novel hermetic terminal assembly 2 which can be sealed in housing wall 5 of a housing such as the housing of a refrigeration compressor (not shown) is disclosed. Terminal assembly 2 includes a cup-shaped body 3 with a generally flat bottom 4 having an inner face 6 and an outer face 7. A flared rim or side wall 8 extends from the inner face 6 of the flat bottom 4 with the bottom 4 having at least one and advantageously two or three holes as shown spaced in equilateral configuration, each with a defined perimeter in the form of an annular lip 11. Current conducting cylindrical pins 12, three in the advantageous embodiment disclosed, are provided Each pin 12 extends centrally through one of the hole perimeters defined by annular lip 11 to have an outer pin segment 13 which extends externally of the outer bottom face 7 and thus the housing wall 5 in which terminal assembly 2 is mounted. Each outer pin segment 13 serves to receive an electrical connection such as 31 (FIG. 3) outside of the housing with which the terminal assembly is associated.

Each inner pin segment 14 of pin 12, in accordance with one feature of the present invention, can be of uniform cross-section throughout without requiring a comparatively costly and difficult to manufacture stop flange as is known in the art. This inner segment 14 serves to connectively receive an electrical connection disposed within the housing in the wall of which the terminal assembly 2 is mounted. A glass seal 16 serves to bind the inner pin segment 14 of each of pins 12 to an annular lip 11 defining one of the holes in flat bottom 4, as known in the art. Also, as known in the art, three electrically insulating ceramic sleeves 17 are provided, each serving to surround the inner segment 14 of one of pins 12. One end of each ceramic sleeve 17 is embedded in an adjacent glass seal 16 and, in accordance with one feature of the present invention, the other end of each sleeve 17 is in the form of a well recess 18 to provide an extended oversurface to reduce possible electrical arcing from pin 12 to cup-shaped body 3. The depth of the well recess 18 is selected to optimize the amount of extended oversurface and at the same time obtain adjacent the embedded sleeve end the maximum insulating thickness between pin and cup-shaped body 3. It is to be understood that this thickness, of course, depends upon the insulating nature of the ceramic chosen for the sleeve.

Each of pins 12, as can be seen in the broken away portion of FIG. 1, can be comprised of an outer jacket 19 which can be of a suitable, electrically conductive ferrous jacketing material such as steel and an inner core 21 which can be of a higher electrically conductive copper. It, of course, is to be understood that each pin can be formed from a single suitable material. Advantageously, the pin 12 can be roll formed and, along a preselected lineal portion thereof, there is provided a fuse-like area in the form of a reduced neck 22 located to be adjacent the outer face 7 of flat bottom 4 of cup-shaped body 3, the pin 12 being preselectively reduced at such fuse-like area 22 so as to have a diameter ratio of steel to copper of approximately two (2) to one (1), thus forming a lineally extending fuse-like neck area adjacent the outer face 7 of bottom 4 to be in the outer pin segment 13 outside the housing wall into which the terminal assembly 2 is to be sealed into position for electrical connection. It is to be understood that the cup-shaped body 3 can be selected from any one of a number of suitable materials, such as steel, and that it, the glass-to-body pin seal and the glass embedded ceramic sleeve can be configured in any one of a number of ways known in the art and advantageously in the manner above discussed to minimize pin arcing and to optimize sleeve insulation.

In accordance with the present invention, a suitable bonding primer 23 is utilized to cover the fuse-like area 22 and the adjacent outer face 7 of flat bottom 4 of cup-shaped body 3. This bonding primer 23 can be selected from any one of a number of suitable bonding materials presently available on the commercial market, such as one of those offered by the Stauffer-Wacker Company. It is essential that the bonding primer 23 serves to firmly bind coating 24 to the fuse-like area 22 in outer pin segment 13 and to the outer face 7 of flat bottom 4. Although it is possible to utilize a number of thermally decomposable materials, advantageously coating 24 can be of a preselected polymeric rubber silicone material and have a preselected thickness to prevent possible pinpoint current leakage during normal operations. In accordance with the present invention, bonding primer 23 and coating 24 should have a thermal decomposition temperature point lower than the melting point temperature of the fuse-like area 22 so as to decompose during excessively abnormal current operating conditions so that the residual insulating powdered silica of the rubber silicone coating 24 serves as an arc suppressant. Advantageously, the melting point of the fuse-like area 22 is higher than the thermal decomposition point of coating 24.

Figure 3:
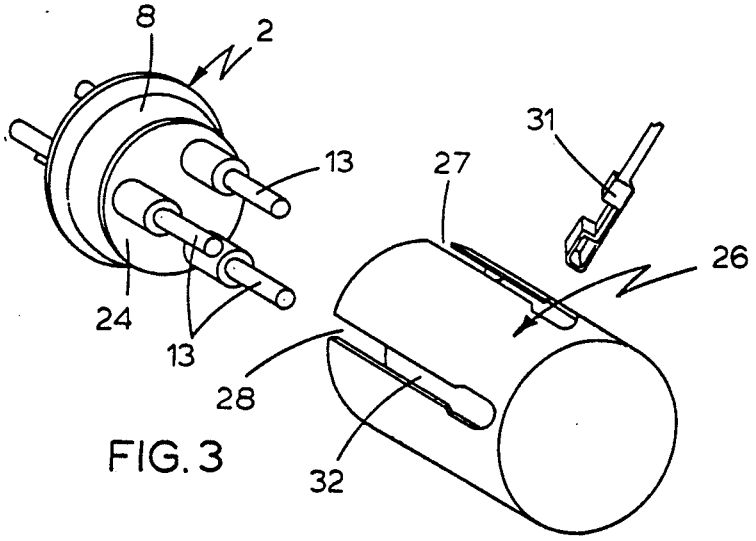
FIG. 3 is an isometric exploded view of the terminal assembly of FIGS. 1 and 2 including one embodiment of a novel, current resistive, protective pin guard and lead wire end connection securing device associated therewith.
Figure 4:
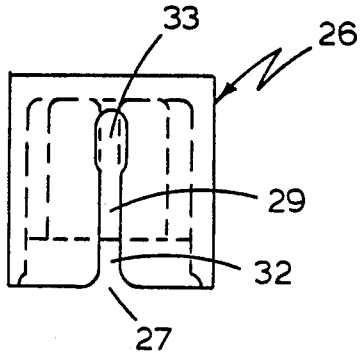
FIG. 4 is a side view of the protective pin guard and lead wire end connection securing device of FIG. 3 showing by broken lines the peripheral slots in the subchannels thereof.
Figure 6:
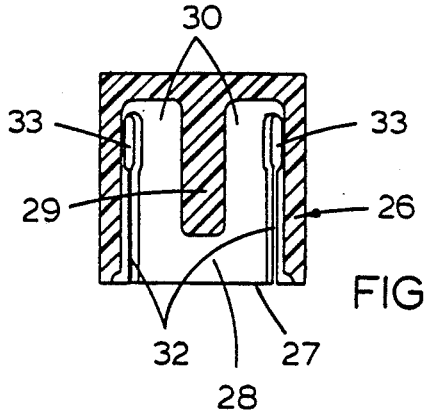
FIG. 6 is a cross-sectional view taken in a plane through line 6—6 of FIG. 5.
Figure 5:
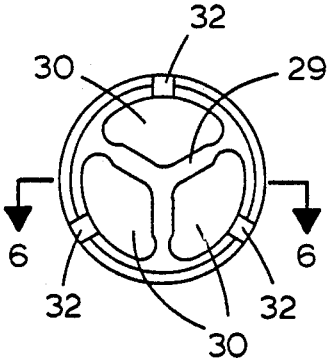
FIG. 5 is a bottom end view of the protective pin guard and lead wire end connection securing device of FIG. 4.

In accordance with still another feature of the present invention and as can be seen in the exploded view of FIG. 3 of the drawings, terminal assembly 2 can be provided with a novel protective pin guard and lead wire end connection securing device in the form of an open-ended thimble 26. Advantageously, thimble 26 can be formed from any one of a number of stable, yet flexible, current resistive plastic materials having a preselected resistance to excess currents and temperatures anticipated. Thimble 26 advantageously can be sized and contoured at its open end 27 to friction fit over rim 8 of terminal assembly 2. Further, the open end 27 of thimble 26 can be firmly bonded to rim 8 with any one of a number of suitable bonding materials so as to fix thimble 26 firmly to terminal assembly 2, not only guarding outer pin segments 13 but limiting access thereto to help reduce possible personnel and material mishaps.

As can be seen in FIGS. 3–6, thimble 26 includes a main channel 28 which communicates with opening 27 and can be divided by an integrally formed spider 29 into three separate pin and lead wire end connection surrounding subchannels 30 coextensive with main channel 28 and which are sized to readily receive and guardedly surround the outer pin segments 13 of the three pins 12 so as to protect the fuse-like area 22 in each outer pin segment 13 and to secure the lead wire end connections 31, the compartments further serving to diffuse any noxious gases and particulate materials in the remote possibility of undesirable leakage through seal 16 of terminal assembly 2 from the housing on which the assembly is mounted.

Figure 7:
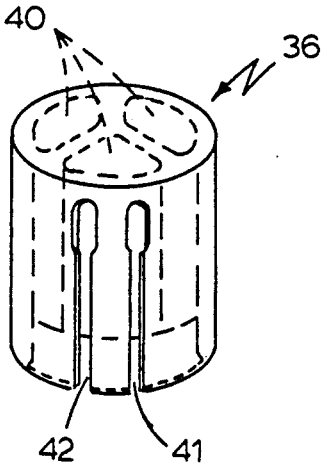
FIG. 7 is an isometric view of a modified embodiment of the novel protective pin guard and lead wire end connection securing device illustrating alternative slots for the lead wire end for each subchannel.

To accommodate the external lead wire end connections 31 and to maintain such wires in secured position in the event of fuse melt, the outer peripheral wall of each subchannel 30 is provided with an appropriately-sized slot 32 lineally extending from open end 27 of thimble 26 to a position adjacent the closed upper cover of guard and lead wire end securing thimble 26, it being noted that an appropriate enlargement 33 can be provided at the end of each slot 32 adjacent the top of the thimble cover to accommodate for lead wire end adjustment. In this regard and referring to FIG. 7 of the drawings which discloses a modified thimble 36, it can be seen that each internal subchannel 40 thereof can be provided along the outer peripheral wall with alternative spaced slots 41 and 42 similar to slots 32, the alternate slots 41 and 42 for each subchannel 40 alloWing selective, alternative positioning and securing of the lead wire end connection to be introduced into the respective subchannel 40.

The invention claimed is:

1. A hermetic terminal assembly for a housing comprising:

a cup-shaped body with a bottom having an inner and outer face and a rim extending from said inner face of said bottom, said bottom having at least one hole with a defined perimeter;

a current conducting pin extending through said hole, said pin having an inner pin segment extending internally of said cup-shaped body and an outer pin segment extending externally of said cup-shaped body to receive and electrical lead wire end connection outside of said cut-shaped body with said inner pin segment serving to receive an electrical lead wire end connection disposed in said housing;

a seal bonding said pin to said defined perimeter of said hole;

said outer pin segment including a fuse-like area adjacent and completely outside said outer face of said bottom of said cup-shaped body; and an insulating thermally decomposable coating fully covering said fuse-like area, said coating having a lower decomposition temperature point than the melting point of said fuse-like area and including an arc suppressant, said coating when decomposed serving to fully cover the outer end of the inner pin segment and thereby abate electrical flow to said inner pin segment in the event of the melting of said fuse-like area due to abnormally excessive current conditions.

2. The hermetic terminal assembly of claim 1, and an electrically insulating sleeve surrounding said inner pin segment with one end of said sleeve embedded in said seal to minimize the possibility of electrical arcing between the pin and said cup-shaped body.

3. The hermetic terminal assembly of claim 1, said inner pin segment being of uniform cross-section throughout.

4. The hermetic terminal assembly of claim 1, said coating extending over both said fuse-like area and said outer face of said bottom, said coating being of a thickness to provide a current barrier.

5. The hermetic terminal assembly of claim 4, and a bonding primer between said outer face of said bottom and said coating.

6. The hermetic terminal assembly of claim 1, said outer pin segment including a lineally extending reduced diameter portion adjacent said outer face of said bottom forming said fuse-like area.

7. The hermetic terminal assembly of claim 1, said pin comprising a ferrous jacket and copper core, said core and jacket having a lineal portion adjacent said outer face of said bottom of said cup-shaped body reduced by rolling to provide said fuse-like area, said reduced lineal portion having a selected ferrous to copper diameter ratio.

8. The hermetic terminal assembly of claim 7, said ferrous to copper diameter ratio being approximately two (2) to one (1).

9. The hermetic terminal assembly of claim 1, said insulating coating comprising a silicon containing polymeric material with the residual powdered silica therein the event of decomposition acting as said arc suppressant.

10. The hermetic terminal assembly of claim 1, said hermetic terminal assembly having a current resistive protective pin guard and lead wire end connection securing device mounted thereon, said pin guard and lead wire end connection securing device having a slotted channel having an open end receiving and surrounding said rim and outer pin segment to allow the lead wire end connection to snuggly pass into said slotted channel and secure said lead wire end connection in said slotted channel to be fastened to the outer pin segment, said pin guard and lead wire end connection securing device surroundingly protecting said outer pin segment and also surroundingly protecting and securing said lead wire end connection when it is connected to said outer pin segment and acting as a diffuser in the event of hermetic terminal assembly leakage.

11. The hermetic terminal assembly with said pin guard and lead wire end connection securing device of claim 10, said pin guard and lead wire end connection securing device being bonded to said rim.

12. The hermetic terminal assembly with said pin guard and lead wire end connection securing device of claim 10, said pin guard and lead wire end connection securing device being of a temperature resistant plastic material.

13. The hermetic terminal assembly of claim 1, said bottom of said sup-shaped body having three spaced holes therein with a current conducting pin extending through each hole, each pin having an outer pin segment to each receive a lead wire end connection.

14. The hermetic terminal assembly of claim 13, said hermetic terminal assembly having an insulating and current resistive protective pin guard and lead wire end connection securing device in the configuration of a thimble frictionally fitted to said rim of said cup-shaped body, said insulating thimble including a partitioning wall therein providing a separate protective and diffuser subchannel for each outer pin segment and each lead wire end connection, each subchannel being slotted to snuggly receive therethrough a lead wire end connection for the outer pin segment extending in each subchannel.

15. The hermetic terminal assembly of claim 14, each of said subchannels being coextensive with a main channel and including a plurality of slots to allow adjustment for said lead wire end connections.

16. The hermetic terminal assembly of claim 1, said inner pin segment having an insulating sleeve surrounding said inner pin segment with one end of said sleeve embedded in said seal and including a sell recess at that end of said sleeve opposite said seal-embedded end to provide an extended oversurface, said wall recess being sized and configured to minimize arcing and optimize insulation.

17. A hermetic terminal assembly for a housing in combination with a pin guard and lead wire end connection securing device comprising:

a cup-shaped body with a bottom having an inner and outer face and a rim extending from said inner face of said bottom, said bottom having three holes spaced in equilateral configuration, each with a defined perimeter;

three current conducting cylindrical pins, each extending through one of said holes to have an outer pin segment extending externally of said housing to receive a lead wire end connection outside of said housing and an inner pin segment of uniform cross-section throughout said inner pin segment to receive a lead wire end connection disposed in said housing;

glass seals bonding each of said pins to said defined perimeters of said holes;

electrically insulating ceramic sleeves surrounding said inner segments of each of said pins with one end of each sleeve embedded in said glass seal for said surrounded inner pin segment and the opposite end having a well recess to provide an extended oversurface sized and configured to minimize arcing and optimize insulation;

each of said pins comprising a steel jacketed copper core, said core and jacket having a lineal portion of each outer pin segment adjacent said outer face of said bottom said cup-shaped body reduced by rolling to provide a fuse-like area of steel to copper diameter ratio of approximately two (2) to one (1);

a bonding primer covering the fuse-lie areas and the outer face of said bottom of said cup-shaped body;

an integral rubber-like silicon containing coating of a thickness covering said bonding primer on said outer fuse-like areas of said pins and said outer face of said bottom, the thermal decomposition point of said bonding primer and said coating being lower than the melting point of said fuse-like areas so that during excessively abnormal current conditions the decomposed material serves as an arc suppressant;

and a plastic, current and high temperature resistive, pin guard and lead wire end connection securing device in the form of an open end thimble contoured at its open end to include a main channel, said open end of said thimble being frictionally fitted over said rim of said cup-shaped body to be firmly bonded thereto, said thimble being divided by an integral separator to provide three longitudinally extending subchannels coextensive with said main channel to each snuggly receive and surround one of said outer pin segments and a lead wire end connection therefor, each of said subchannels being slotted along the outer wall thereof to receive therethrough and secure the lead wire end connection for said outer pin segment.

18. In combination with a hermetic terminal assembly having at least one protruding fuse-like outer pin segment to be fastened to a lead wire end connection, a current resistive protective pin guard and lead wire end connection securing device engaging said terminal assembly, said protective pin guard and lead wire end connection securing device including an enclosed channel having an open end sized to engagingly receive and protect said fuse-like outer pin segment within said channel, said channel acting as a diffuser in the event of terminal assembly leakage and including a slot to receive and secure said lead wire end connection therein to be fastened to said fuse-like outer pin segment.

19. The combination of claim 18, said pin guard and lead wire end connection securing device being of stable, flexible plastic in the configuration of an open-ended main channel defining a hollow thimble sized and contoured to allow the end thereof to friction-fit to said terminal assembly.

20. The combination of claim 19, said hermetic terminal assembly having at least two spaced outer pin segments and said thimble having an integral spider disposed therein to divide said main channel defined by said open-ended hollow thimble into at least two coextensive subchannels to provide a separate subchannel for each of said outer pin segments.

21. The combination of claim 20, including at least one lineally extending slot in the outer peripheral wall of each subchannel sized to snugly receive and secure a lead wire end connection.

22. The combination of claim 21, including at least two lineally extending slots in a subchannel to allow alternative slot selection for a lead wire end connection.

* * * * *

UNITED STATES PATENT AND TRADEMARK OFFICE

CERTIFICATE OF CORRECTION

PATENT NO. : 5,017,740

DATED : May 21, 1991

INVENTOR(S) : Glenn A. Honkamp et al

It is certified that error appears in the above—identified patent and that said Letters Patent is hereby corrected as shown below:

Claim 13, column 7, line 58 delete "sup-shaped" and insert -- cup-shaped --;

Claim 16, column 8, line 13, delete "sell" and insert - well --;

Claim 17, column 8, line 49 delete "fuse-lie" and insert -- fuse-like --.

Signed and Sealed this

Fifth Day of January, 1993

*Attest:*

DOUGLAS B. COMER

*Attesting Officer*

*Acting Commissioner of Patents and Trademarks*